US010527068B2

(12) United States Patent
Parthasarathy et al.

(10) Patent No.: US 10,527,068 B2
(45) Date of Patent: Jan. 7, 2020

(54) SYSTEM FOR HYDRAULIC PRESSURE RELIEF VALVE OPERATION

(71) Applicant: Expro Americas, LLC, Houston, TX (US)

(72) Inventors: Anand Parthasarathy, Cypress, TX (US); Scott Charles, Houston, TX (US)

(73) Assignee: Expro Americas, LLC, Houston, TX (US)

( * ) Notice: Subject to any disclaimer, the term of this patent is extended or adjusted under 35 U.S.C. 154(b) by 155 days.

(21) Appl. No.: 15/680,527

(22) Filed: Aug. 18, 2017

(65) Prior Publication Data

US 2019/0055966 A1 Feb. 21, 2019

(51) Int. Cl.

| | |
|---|---|
| ***F15B 13/02*** | (2006.01) |
| ***F15B 1/04*** | (2006.01) |
| ***F15B 1/26*** | (2006.01) |
| ***F15B 11/08*** | (2006.01) |
| ***F15B 13/044*** | (2006.01) |
| ***F15B 21/08*** | (2006.01) |

(52) U.S. Cl.

CPC ..... *F15B 13/024* (2013.01); *F15B 1/04* (2013.01); *F15B 1/265* (2013.01); *F15B 11/08* (2013.01); *F15B 13/044* (2013.01); *F15B 21/08* (2013.01); *F15B 2211/30525* (2013.01); *F15B 2211/315* (2013.01); *F15B 2211/863* (2013.01); *Y10T 137/87169* (2015.04)

(58) Field of Classification Search

CPC ..... F15B 20/002; F15B 13/0405; F15B 2211/3157; F15B 2211/8752; F15B 2211/55; F15B 2211/327; F15B 2211/862; F15B 13/024; F15B 1/265; F15B 13/044; F15B 1/04; F15B 11/08; F15B 21/08; F15B 2211/863; F15B 2211/30525; F15B 2211/315

USPC .... 137/269, 596.14–596.18, 599.04–599.07, 137/487.5

See application file for complete search history.

(56) References Cited

U.S. PATENT DOCUMENTS 4,142,368 A 3/1979 Mantegani
4,548,296 A * 10/1985 Hasegawa ..... B66F 9/22 137/486

(Continued)

FOREIGN PATENT DOCUMENTS

| | | | |
|---|---|---|---|
| CN | 204784959 | U | 11/2015 |
| CN | 205605942 | U | 11/2015 |
| WO | WO2016166533 | A1 | 10/2016 |

OTHER PUBLICATIONS

International search report for PCT/US18/046839 dated Feb. 21, 2019.

*Primary Examiner* — Umashankar Venkatesan
(74) *Attorney, Agent, or Firm* — O'Shea Getz P.C.

(57) ABSTRACT

A hydraulic power unit (HPU) configured for use with a pressure relief valve (PRV) having an open port and a close port is provided. The HPU includes a pneumatic primary pump, a hydraulic fluid reservoir, an accumulator, and a two position solenoid directional valve (TPSDV). The hydraulic fluid reservoir is in fluid communication with the primary pump. The TPSDV is in communication with the primary pump, the reservoir, the accumulator. The TPSDV is configured for fluid communication with the PRV. The HPU is configurable in a PRV fail open configuration and a PRV fail close configuration.

19 Claims, 6 Drawing Sheets

(56) References Cited

U.S. PATENT DOCUMENTS

| | | | | |
|---|---|---|---|---|
| 4,559,965 | A * | 12/1985 | Mickelson | F15B 11/055 137/115.21 |
| 6,164,322 | A | 12/2000 | Najmolhoda et al. | |
| 6,305,264 | B1 * | 10/2001 | Yang | F15B 11/042 91/447 |
| 8,061,384 | B2 | 11/2011 | Isono | |
| 8,413,677 | B1 * | 4/2013 | Coffman | F15B 13/024 137/487.5 |
| 8,925,895 | B2 | 1/2015 | Takemoto | |
| 9,109,717 | B2 | 8/2015 | Crawford | |
| 9,273,543 | B2 | 3/2016 | Baca et al. | |
| 9,523,296 | B2 | 12/2016 | Apostolides | |
| 2016/0032945 | A1 | 2/2016 | Cho et al. | |
| 2016/0084279 | A1 | 3/2016 | Brahmer | |
| 2016/0363140 | A1 | 12/2016 | Mizukami | |

* cited by examiner

FAIL CLOSE CONFIGURATION

FAIL OPEN CONFIGURATION

FAIL CLOSE CONFIGURATION

FAIL OPEN CONFIGURATION

FAIL CLOSE CONFIGURATION

FAIL OPEN CONFIGURATION

SYSTEM FOR HYDRAULIC PRESSURE RELIEF VALVE OPERATION

BACKGROUND OF THE INVENTION

1. Field of the Invention

The present disclosure relates to a system that includes a hydraulic pressure unit and a pressure relief valve. More particularly, the present invention relates to a method and apparatus for enhancing the operation of a hydraulic unit in combination with a pressure relief valve.

2. Description of the Related Art

Relief valves are used for processes involving flow to ensure that excessive system pressures will not cause major failures in the system. Typical relief valve control systems are used to control the relief valves associated with mud pumps on drilling rigs. These pumps are high powered and deliver fluids at high flow rates and delivery pressures.

Starting a pump against a closed valve or a plugged line may result in major damage to the system unless the system contains a pressure relief valve that can operate to avoid the over pressurization.

Hydraulic power units ("HPUs") are often designed so that a pressure relief valve ("PRV") is opened when fluid pressure at a particular point in the system exceeds a predetermined set point, and may be closed when the aforesaid fluid pressure drops to a predetermined set point. Some prior art HPUs are designed to operate a PRV to protect drilling equipment (e.g., a mud pump) from over-pressure. In such instances, an HPU may be configured to assume a "Fail Open" configuration when there is loss of power supply or loss of solenoid signal. An example of such a system is described in U.S. Pat. No. 8,413,677. In certain circumstances, a loss in pressure may affect a drilling operation and may cause a potentially dangerous situation. Hence, there is a need for an HPU system that can readily configured to accommodate a plurality of different failure modes without significant modifications.

Some prior art HPUs may also be configured to operate hydraulically actuated non-proportional valves having two states: an open state or a closed state. This may be accomplished by means of an HPU that includes components such as a pump, relief valves, directional valves, ball valves, a reservoir, an accumulator, etc. The HPU pump may be configured to build hydraulic pressure by drawing oil from a reservoir and then using a directional valve to divert oil flow to open or close the non-proportional valve. Many prior art HPUs, however, are relatively complex, using a plurality of control valves and accumulators which in turn creates a plurality of failure points within the HPU. In addition, many prior art HPUs do not use a return filter for hydraulic fluid going into reservoir, which can lead to oil contamination and pump damage over time. Still further, many prior art HPUs utilize a single pump. If a suction filter disposed between the reservoir and the pump gets clogged, the suction filter may will prevent fluid from reaching the pump thereby causing the pump to stall.

What is needed is an HPU system having fewer potential HPU failure point, and one that is readily configured to accommodate a plurality of different well failure modes without significant modifications.

SUMMARY OF THE INVENTION

According to an aspect of the present disclosure, a hydraulic power unit (HPU) configured for use with a pressure relief valve having an open port and a close port is provided. The HPU comprises a pneumatic primary pump, a hydraulic fluid reservoir, an accumulator, and a two position solenoid directional valve (TPSDV). The hydraulic fluid reservoir is in fluid communication with the primary pump. The TPSDV is in communication with the primary pump, the reservoir, the accumulator. The TPSDV is configured for fluid communication with the PRV. The HPU is configurable in a pressure relief valve (PRV) fail open configuration and a PRV fail close configuration.

According to a second aspect of the present disclosure a hydraulic power unit system is provided that includes a pressure relief valve (PRV) and a hydraulic power unit (HPU. The PRV has an open port and a close port. The HPU includes a pneumatic primary pump, a hydraulic fluid reservoir, an accumulator, and a first two position solenoid directional valve (TPSDV). The hydraulic fluid reservoir is in fluid communication with the primary pump. The first TPSDV is in communication with the primary pump, the reservoir, the accumulator. The first TPSDV is configured for fluid communication with the PRV. The HPU may be configurable in both a PRV fail open configuration and a PRV fail close configuration.

According to the above aspects or embodiment thereof, in the PRV fail CLOSE configuration, the HPU may be configured to provide hydraulic fluid at an elevated pressure to the close port of the PRV, which elevated pressure is adequate to maintain the PRV in a closed configuration.

According to the above aspects or embodiment thereof, in the PRV fail OPEN configuration, the HPU may be configured to provide hydraulic fluid at an elevated pressure to the open port of the PRV, which elevated pressure is adequate to maintain the PRV in an open configuration.

According to the above aspects or embodiments thereof, the HPU may further comprise at least one first fluid line providing fluid communication between the TPSDV and the close port of the PRV, at least one second fluid line providing fluid communication between the TPSDV and the open port of the PRV, and at least one valve in fluid communication with the at least one second fluid line. The at least one valve is configured so that fluid flow from the open port of the PRV is restricted.

According to the above aspects and embodiments thereof, the HPU may include at least one first fluid line providing fluid communication between the TPSDV and the close port of the PRV, at least one second fluid line providing fluid communication between the TPSDV and the open port of the PRV, and at least one valve in fluid communication with the at least one second fluid line. The at least one valve is configured to permit fluid flow at an elevated pressure to pass through the at least one valve to the open port of the PRV.

According to the above aspects and embodiments thereof, the at least one valve may include at least one fluid flow restriction valve and at least one fluid flow valve disposed in parallel with one another, and the fluid flow valve has an open configuration and a closed configuration, and in the closed configuration fluid flow from the PRV passes through the at least one fluid flow restriction valve.

According to the above aspects or embodiments thereof, the HPU may be further configurable in a pressure relief valve PRV fail as-is configuration.

According to the above aspects or embodiment thereof, in the PRV fail CLOSE configuration, the HPU may be configured to provide hydraulic fluid at an elevated pressure to the close port of the PRV, which elevated pressure is adequate to maintain the PRV in a closed configuration, and in the PRV fail OPEN configuration, and the HPU may be configured to provide hydraulic fluid at an elevated pressure to the open port of the PRV, which elevated pressure is adequate to maintain the PRV in an open configuration.

According to the above aspect or embodiment thereof, the HPU further may include a second TPSDV and a controller. The controller includes at least one processor in communication with the second TPSDV and a memory storing instructions, which instructions when executed cause the processor to selectively operate the second TPSDV in a first configuration or a second configuration. In the first configuration, at least one first fluid line provides fluid communication between the first TPSDV and the close port of the PRV, and at least one second fluid line provides fluid communication between the first TPSDV and the open port of the PRV. In the second configuration the at least one first fluid line provides fluid communication between the first TPSDV and the open port of the PRV, and the at least one second fluid line provides fluid communication between the first TPSDV and the close port of the PRV.

According to the above aspect or embodiment thereof, the HPU may include a controller that includes at least one processor in communication with a first fluid flow valve and a second fluid flow valve, and a memory storing instructions. The instructions when executed may cause the processor to selectively operate the first fluid flow valve in a first open configuration or a first close configuration, and to selectively operate the second fluid flow valve in a second open configuration or a second close configuration.

According to the any aspect or embodiment thereof, the hydraulic fluid reservoir may include at least one of a float switch or a sight glass.

According to the any aspect or embodiment thereof, the HPU may include a pneumatic secondary pump in fluid communication with the TPSDV.

The foregoing has outlined rather broadly several aspects of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings.

DESCRIPTION OF THE PREFERRED EMBODIMENTS

Figure 1:
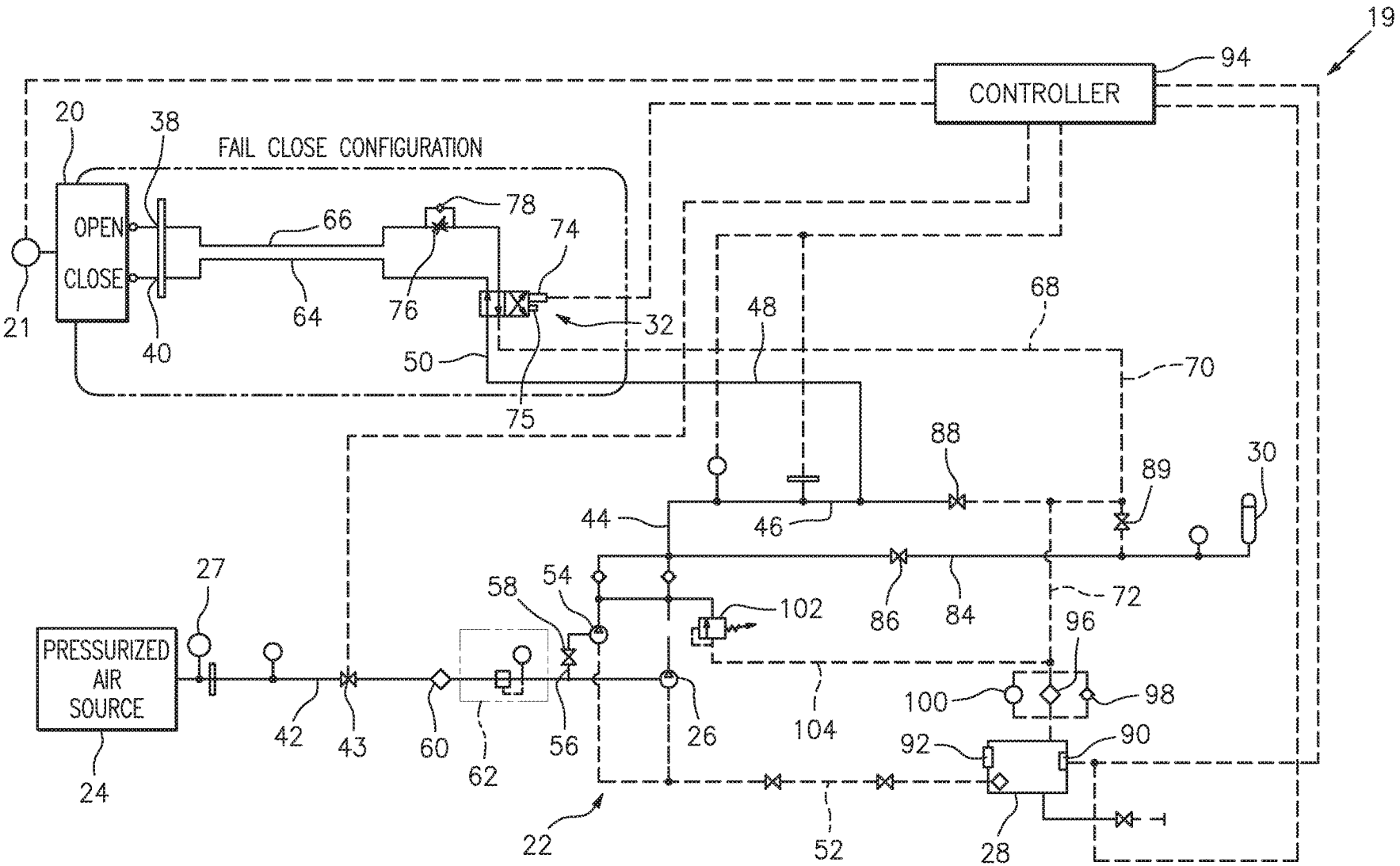
FIG. 1 is a schematic diagram of a hydraulic power unit embodiment.

Referring to FIG. 1, aspects of the present disclosure include a system 19 that includes a pressure relief valve ("PRV") 20, and a hydraulic power unit 22 ("HPU 22") configured to operate a PRV 20. The HPU 22 may be configured to receive pressurized air from a pressurized air source 24, and includes a primary pump 26, a reservoir 28, an accumulator 30, and a two position solenoid directional valve (4w/2p) 32. As will be described below, the HPU 22 may be configured to provide three different failure modes relating to loss of power supply/loss of solenoid signal scenarios; e.g., a PRV "fail CLOSE" configuration, a PRV "fail OPEN" configuration, and a PRV "fail AS-IS" configuration. The HPU 22 may be used for, but is not limited to use within, hydrocarbon well drilling applications; e.g., protection of hydrocarbon well drilling equipment (such as mud pumps) protection applications.

Figure 2:
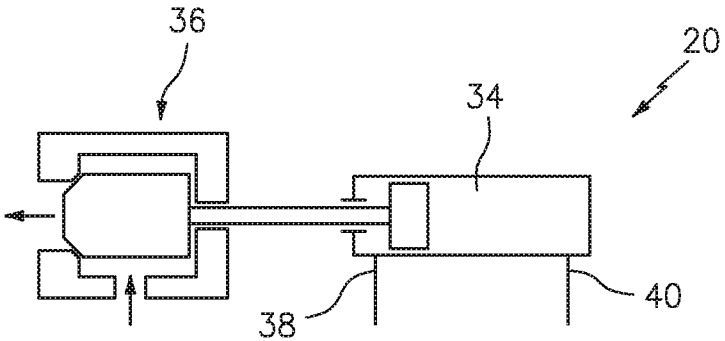
FIG. 2 is a diagrammatic view of a pressure relief valve.

Referring to FIG. 2, the PRV 20 includes a hydraulic actuator 34 (e.g., a cylinder) that is operable to actuate a valve 36 in communication with a fluid system such as a mud pump system on a well drilling rig. The PRV 20 includes an OPEN port 38 and a CLOSE port 40. The PRV 20 is configured so that hydraulic fluid at or above a predetermined pressure provided to the OPEN port 38 will cause the PRV 20 to open. Similarly, the PRV 20 is configured so that hydraulic fluid at or above a predetermined pressure provided to the CLOSE port 40 will cause the PRV 20 to close. The present disclosure may be used with a variety of different types of PRVs, and therefore is not limited to use with any particular type PRV. A non-limiting example of an acceptable PRV is disclosed in U.S. Pat. No. 8,413,677 which is hereby incorporated by reference in its entirety. The PRV 20 may include a well fluid pressure sensor 21 that is in communication with the controller 94.

Referring to FIGS. 1-4, the primary pump 26 may be a pneumatically powered pump sized to produce hydraulic fluid pressure within the HPU 22 in a range that is adequate to operate the PRV 20. The primary pump 26 is in fluid communication with the pressurized air source 24 via line 42. The line 42 may include a pressurized air source pressure sensor 27 (that may be in communication with the controller 94). The term "line" as used herein is defined as a conduit (e.g., a tube, a pipe, a hose, etc.) through which a fluid at a pressure above ambient can be passed. The primary pump 26 is in selective fluid communication with the PRV 20 via lines 44-50, and in fluid communication with a hydraulic fluid suction line 52 that extends back to the reservoir 28. A dump valve 88 may be in communication with pressure side line 46 (which is in communication with the primary pump 26), and in communication with the reservoir 28 via return line 72. The primary hydraulic pump 26 may be controlled via a valve 43 disposed in line 42 that is configured to regulate the flow of air to the pump 26 from the pressurized air source 24, which valve 43 may be in communication with the controller 94.

In some embodiments, the HPU 22 may include a secondary pump 54. The secondary pump 54 may also be pneumatically powered, and is sized to operate the PRV 20 in the event of a primary pump 26 failure. The secondary pump 54 is in fluid communication with the pressurized air source 24 via lines 42, 56, with a valve 58 (e.g., a ball valve) disposed in the line 56 connecting the secondary valve to the pressurized air source 24 via line 42. When the valve 58 is open, pressurized air is fed to the secondary pump 54 so that the secondary pump 54 may build up an amount of hydraulic pressure that is adequate to keep the HPU 22 and PRV 20 operational; e.g., so the PRV 20 can be switched between an OPEN configuration and a CLOSE configuration. The secondary pump 54 is in fluid communication with hydraulic fluid suction line 52 that extends back to the reservoir 28. The secondary pump 54 may provide a back up to the primary pump 26 to ensure that the criticality of the PRV 20 operation is not affected if the primary pump 26 is not available. The secondary hydraulic pump 54 may be controlled via a valve 43 disposed in line 42 that is configured to regulate the flow of air to the pump 54 from the pressurized air source 24, which valve 43 may be in communication with the controller 94.

In some embodiments, a filter 60 may be disposed in line 42 between the pressurized air source 24 and the primary pump 26 (and secondary pump 54 as applicable).

In some embodiments, a filter regulator lubricator 62 ("FRL") may be disposed in line 42 between the pressurized air source 24 and the pump to provide conditioned air to the primary pump 26 (and the secondary pump 54 in some instances) as required.

A single two position solenoid directional valve 32 ("TPSDV"; 4 way/2 position) is disposed downstream of the primary pump 26 (and secondary pump 54 in some embodiments) via lines 44-50 and upstream of the PRV 20 via lines 64, 66. The TPSDV 32 is in fluid communication with the reservoir 28 via lines 68-72. The TPSDV 32 is, therefore, in fluid communication with primary pump 26 (and the secondary pump 54 in some embodiments), the PRV 20, and the reservoir 28. The configuration of the TPSDV 32 itself, and its position within the HPU 22 enables configurable PRV 20 operation without the need for multiple directional valves. As a result, the number of components within the HPU 22 and the potential for failure of each component is reduced.

In some embodiments, the TPSDV 32 has a spring return solenoid 74. The TPSDV 32 is configured to fail default to one of the two positions. For example, an HPU 22 that is configurable in a PRV fail OPEN mode or an HPU 22 that is configurable in a PRV fail CLOSE mode, may use a TPSDV 32 that has a spring return solenoid 74. In some embodiments, the TPSDV 32 may be detented instead of having a spring return, and may include a pair of solenoids 74, 74A (See FIG. 5). The detented TPSDV 32 coupled with the PRV 20 results in the TPSDV 32 having a fail default in its current position. As a result, the PRV 20 also remains in its current state OPEN or CLOSE configuration upon loss of power/loss of solenoid signal; i.e., this HPU configuration may be described as a PRV fail AS-IS configuration. For example, if the PRV 20 is in an OPEN configuration and there is loss of power/loss of solenoid signal, the TPSDV 32 would be remain in its current position which in turn would cause the PRV 20 to also remain in an OPEN configuration. Conversely, if the PRV 20 is in a CLOSED configuration and there is loss of power/loss of solenoid signal, the TPSDV 32 would be remain in its current position which in turn would cause the PRV 20 to also remain in a CLOSED configuration.

In some embodiments, the TPSDV 32 may have a manual push button override feature 75 which can be used if the TPSDV solenoid 74 (or solenoid 74A) is stuck and unable to be activated via a solenoid signal.

Figure 3:
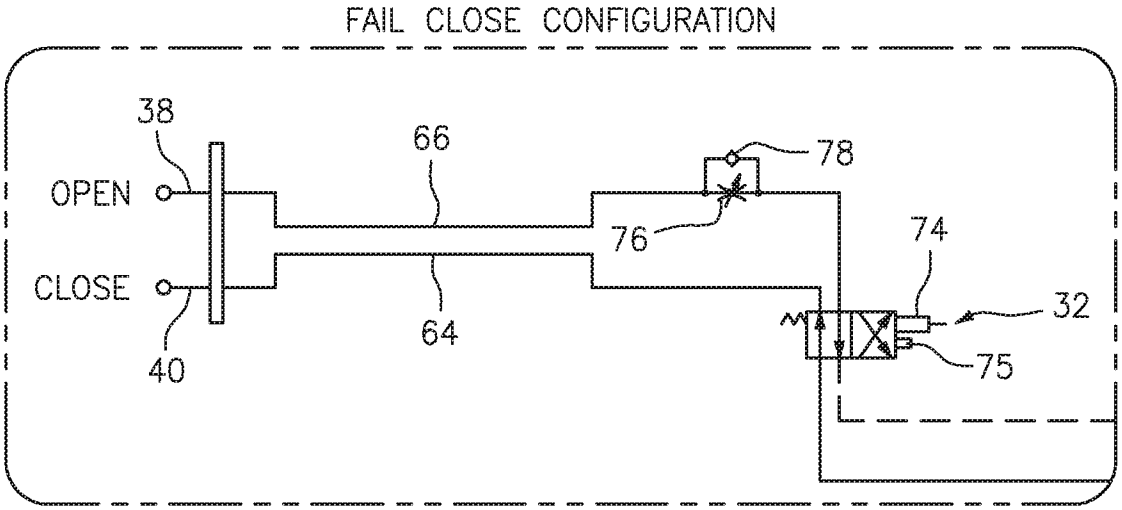
FIG. 3 is a schematic view of a portion of an embodiment of the hydraulic power unit embodiment shown in FIG. 1, showing a fail CLOSE configuration.
Figure 4:
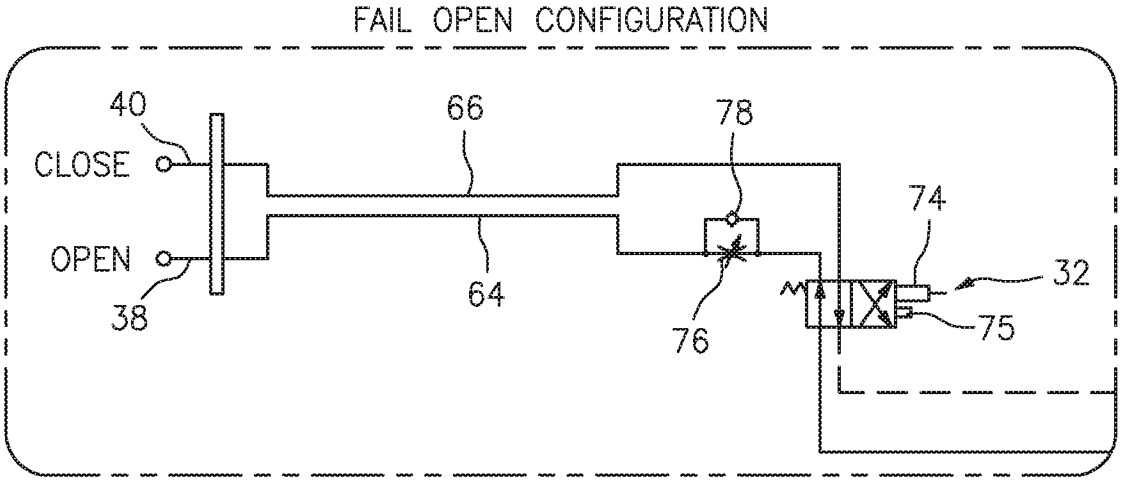
FIG. 4 is a schematic view of a portion of an embodiment of the hydraulic power unit embodiment shown in FIG. 1, showing a fail OPEN configuration.

In some embodiments, one of the lines 64, 66 connecting the TPSDV 32 to the PRV 20 may include a valve configuration that facilitates operation of the PRV 20. For example, the valve configuration may be such that during normal operation of the PRV 20, fluid flow is selectively allowed to either the PRV OPEN port 38 or the PRV CLOSE port 40 in a substantially unimpeded manner. However, when it is desirable to change the position of the PRV 20 (e.g., from a closed configuration to an open configuration, or vice versa), the valve configuration permits the PRV 20 to open quickly, and to close in a controlled manner; e.g., to prevent damage to the PRV 20. Non-limited examples of such a valve configuration can be seen in FIGS. 3 and 4. In FIG. 3, a PRV fail CLOSE configuration is shown wherein a throttle valve 76 (e.g., an orifice) and a check valve 78 are disposed in parallel within line 66 that connects the TPSDV 32 to the PRV 20. In this configuration, hydraulic fluid may be passed to the OPEN port 38 of the PRV 20 from the TPSDV 32 in a substantially unimpeded manner; e.g., the directional check valve 78 allows fluid flow to the PRV OPEN port 38. In this configuration, if the HPU 22 is operated to change from an OPEN configuration to a CLOSE configuration, hydraulic fluid exiting the PRV OPEN port 38 is not permitted to pass through the directional check valve 78, but rather must pass through the throttle valve 76. The throttle valve 76 impedes the flow of the exiting hydraulic fluid and thereby prevents PRV 20 closure in a manner that may damage the PRV 20; i.e., the throttle valve 76 creates a cushioning effect when the PRV 20 closes, and avoids the potential for ramming the PRV 20 which can be detrimental to the trims within the PRV 20. In FIG. 4, a PRV fail OPEN configuration is shown wherein a throttle valve 76 (e.g., an orifice) and a check valve 78 are disposed in parallel within line 64 that connects the TPSDV 32 to the PRV 20. The functionality of the valve configuration is the similar to that described above with respect to FIG. 3. In this configuration, if the HPU 22 is operated to change from an OPEN configuration to a CLOSE configuration, hydraulic fluid exiting the PRV OPEN port 38 is not permitted to pass through the directional check valve 78, but rather must pass through the throttle valve 76. The throttle valve 76 impedes the flow of the exiting hydraulic fluid and thereby prevents PRV 20 closure in a manner that may damage the PRV 20. The exemplary valve configuration (i.e., a check valve 78 and a throttle valve 76) described is an example of a valve configuration, and the present disclosure is not limited thereto. Alternative valve configurations may include the use of a single valve configuration that provides the functionality of a directional valve and a flow restriction valve, an adjustable orifice valve (manual or solenoid operated), a two position flow valve (manual or solenoid operated), etc. Solenoid or other electromechanical valves may be configured for control by the controller 94.

In some embodiments (see FIGS. 6 and 7), a valve configuration functionally equivalent to that described above may be disposed within both of the lines 64, 66 connecting the TPSDV 32 to the PRV 20. For example, a throttle valve 76 and a check valve 78 disposed in parallel may be disposed within both of the lines 64, 66 connecting the TPSDV 32 to the PRV 20. The parallel throttle valve 76 and check valve 78 are configured in each line 64, 66 so that fluid flow to the PRV 20 through one of the lines 64, 66 passes principally through the directional check valve 78 (i.e., path of least resistance) with minimal impedance, and fluid exiting the PRV 20 through the other line 66, 64 cannot pass through the check valve 78 but must instead pass through the throttle valve 76. Embodiments that include a throttle valve 76 and a check valve 78 disposed in parallel within both of the lines 64, 66 connecting the TPSDV 32 to the PRV 20 facilitate converting the HPU 22 from a fail OPEN configuration to a fail CLOSE configuration (and vice versa); e.g., there is no need to remove the throttle valve 76/check valve 78 from one line (e.g., line 64 or line 66) to the other (e.g., line 66 or line 64) to change from one configuration to the other. Hence, the HPU 22 can accommodate multiple failure operational modes in a single HPU 22 design. In those embodiments wherein a throttle valve 76 (or other flow restriction device) is used, an adjustable orifice throttle valve (e.g., solenoid operated that may be controlled by the controller 94) may be used to minimize or remove the fluid flow restriction that would otherwise be caused by the valve in situations where it is desired to open the PRV as quickly as possible.

Figure 8:
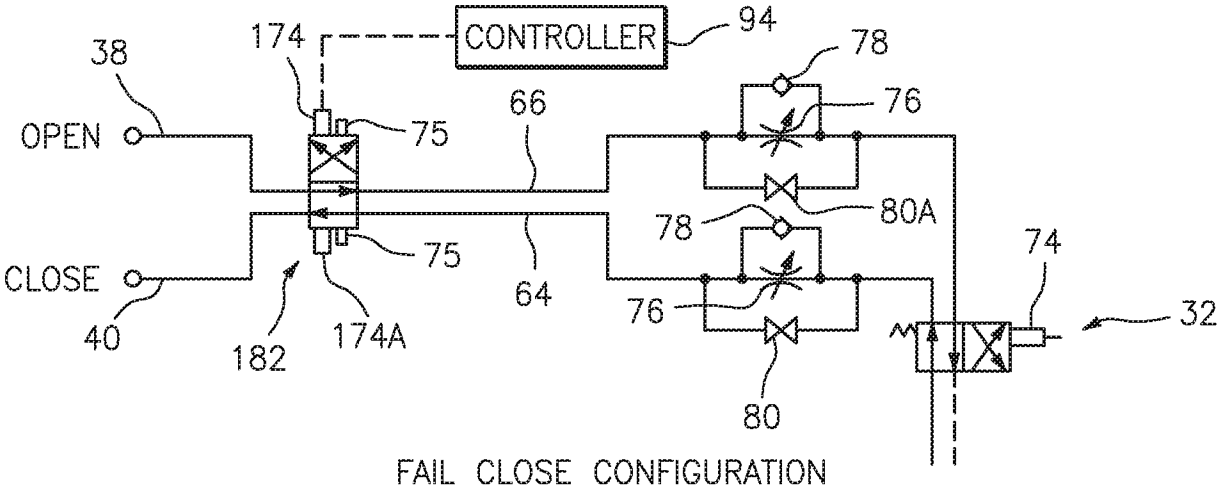
FIG. 8 is a schematic view of a portion of an embodiment of the hydraulic power unit embodiment shown in FIG. 1, showing a fail CLOSE configuration.
Figure 8A:
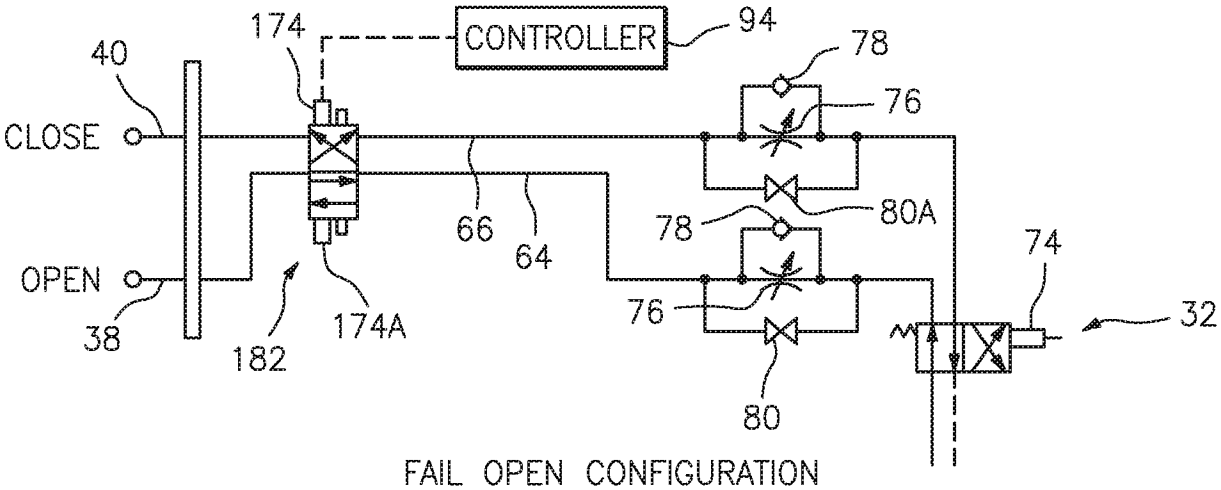
FIG. 8A is a schematic view of a portion of an embodiment of the hydraulic power unit embodiment shown in FIG. 1, showing a fail OPEN configuration.

As will be explained below and shown in FIGS. 8 and 8A, in some embodiments a two position directional valve 182 (4way/2pos) having a pair of solenoids 174, 174A may be in communication with the lines 64, 66 extending between the TPSDV 32 and the PRV 20. The two position directional valve 182 may actuated via instructions from the controller 94 to change the fluid communication paths between the lines 64, 66 and the OPEN and CLOSE ports 38, 40 of the PRV; e.g., the controller may include instructions (e.g., operated via user input) that when implemented cause the two position directional valve 182 to switch positions, thereby changing the HPU from a fail OPEN configuration (e.g., see FIG. 8A) to a fail CLOSE configuration (e.g., see FIG. 8), or vice versa. The two position directional valve 182 may be operated to switch positions for purposes other than changing the HPU 22 configuration.

Figure 9:
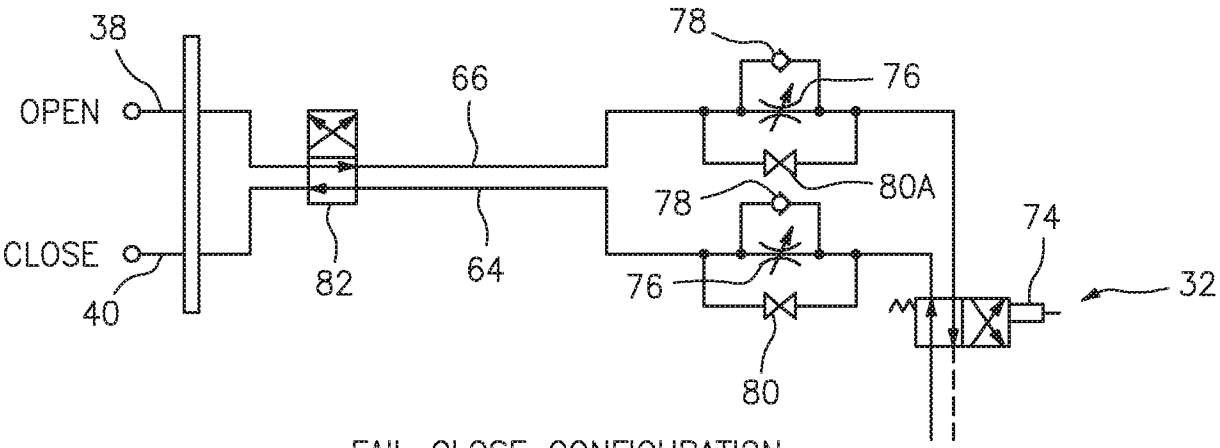
FIG. 9 is a schematic view of a portion of an embodiment of the hydraulic power unit embodiment shown in FIG. 1, showing a fail CLOSE configuration.
Figure 9A:
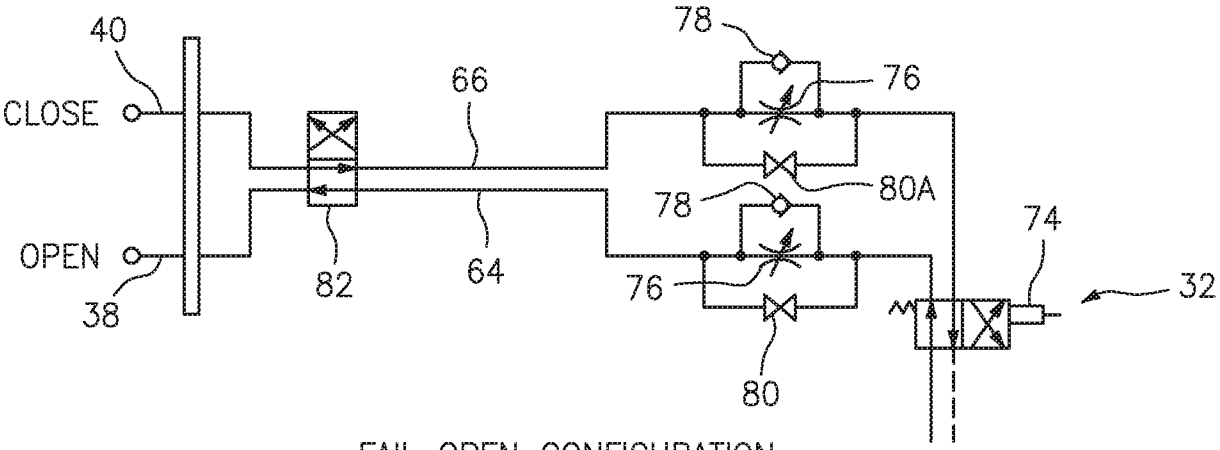
FIG. 9A is a schematic view of a portion of an embodiment of the hydraulic power unit embodiment shown in FIG. 1, showing a fail OPEN configuration.

Referring to FIGS. 9 and 9A, in some embodiments a valve 80 (e.g., a ball valve) may be in communication with one of the lines 64, 66 connecting the TPSDV 32 to the PRV 20, configured to permit fluid to bypass the valve configuration (e.g., throttle valve 76 and a check valve 78) disposed in parallel. In some embodiments, a first valve 80 (e.g., a ball valve) may be in communication with one of the lines 64 connecting the TPSDV 32 to the PRV 20, and a second valve 80A may be in communication with the other line 66 connecting the TPSDV 32 to the PRV 20, with both the first and second valves 80, 80A configured to permit fluid to bypass the respective valve configuration (e.g., throttle valve 76 and a check valve 78). Each valve 80, 80A may be manually operated between a closed configuration and an open configuration. Alternatively, each valve 80, 80A may be configured for automated operation; e.g., solenoid operated valves 80, 80A. The automated valves 80, 80A may actuated via instructions from the controller 94 to change from an open configuration to a closed configuration, or vice versa. The HPU 22 configuration shown in FIGS. 8 and 8A utilizes both the two position directional valve 182 and the valves 80, 80A for increased operational versatility.

In some embodiments (e.g., see FIGS. 6 and 7), a manual two position directional valve 82 (4way/2pos) may be in communication with the lines 64, 66 extending between the TPSDV 32 and the PRV 20. During a fail OPEN configuration or a fail CLOSE configuration, the manual lever detent valve 82 located downstream of the TPSDV 32 can be used to manually open and close PRV 20 using pump flow passing though the defaulted fail position of the TPSDV 32.

The accumulator 30 is in fluid communication with the TPSDV 32 via lines 84, 44, 46, 48, 50. An isolation valve 86 may be disposed in the hydraulic fluid line 84 between the primary pump 26 and the accumulator 30. A dump valve 89 may be in communication with hydraulic fluid line 46 between the reservoir 28 and the accumulator 30, and in communication with the reservoir 28 via line 72. The accumulator 30 may be configured to provide increased pump fluid flow and/or to act as fluid pressure source when the pump is not operating or is functioning adequately to power the PRV 20.

In some embodiments, the HPU 22 may include a float switch 90 disposed with the reservoir 28 and/or a reservoir sight glass 92. The float switch 90 may be installed on the reservoir 28 at a location deemed as the minimum acceptable level of hydraulic fluid in reservoir 28. When the oil level falls below the float switch 90 location, the float switch 90 sends a signal (e.g., a digital signal) to a controller 94 to indicate low reservoir level (e.g., an alarm message) and the signal may also be sent to alarm devices such as beacons/audible devices to alert the user of the low hydraulic fluid condition. The signal from the float switch 90 sent to the controller 94 may also be used to control the valve 43 disposed in line 42 that is configured to regulate the flow of air to the pump 26, 54 from the pressurized air source 24; e.g., if a low hydraulic fluid condition is sensed, the pump 26, 54 may be shut down by closing the air source to prevent damage within pump 26, 54. The float switch 90 provides redundancy in reservoir 28 level monitoring that ensures that the user is alerted so that the pump 26, 54 can be prevented from a potentially damaging run dry condition. The avoidance of a pump "run dry" condition is significant also because a pump "run dry" condition can negatively affect the operation of the PRV 20.

In some embodiments, the HPU 22 may include a return filter 96 configured to filter hydraulic fluid returning to the reservoir 28. The hydraulic fluid passing through the HPU hydraulic system 19 (e.g., through the pumps 26, 54, the hydraulic lines, the valves, other HPU fluid components, and through PRV 20) may pick up contaminants before returning to the reservoir 28. Hydraulic pumps, in particular, can over time be susceptible to damage caused by contaminated hydraulic fluid. The return filter 96 removes contaminates from the hydraulic fluid before the fluid reaches the reservoir 28 and is subsequently drawn into the HPU hydraulic system 19 via the pump. FIG. 1 illustrates a non-limiting example wherein the return filter 96 is disposed within a hydraulic fluid suction line 72 in communication with the reservoir 28. In the embodiment shown in FIG. 1, a bypass valve 98 is included configured to allow hydraulic fluid bypass; e.g., the bypass valve 98 may be a pressure threshold check valve that opens upon exposure to a predetermined fluid pressure such as may happen if the return filter 96 becomes clogged. The aforesaid embodiment also includes a pressure gauge 100 configured to detect and show a differential pressure across the return filter 96; e.g., to enable a user to evaluate the performance of the return filter 96/fluid flow impediment across the return filter 96.

The HPU 22 may include other components that facilitate the operation of the HPU 22, and/or facilitate safe operation of the HPU 22. For example, the HPU 22 configuration shown in FIG. 1 includes a pressure relief valve 102 in fluid communication with the pump pressurized hydraulic line 44 and with a line 104 extending to the reservoir 28. The pressure relief valve 102 may be configured to open and dump hydraulic fluid back to the reservoir 28 if fluid pressure within the pump pressurized hydraulic line 44 exceeds predetermined limit, which excessive pressure may otherwise damage PRV externals. In addition, the HPU 22 may include pressure gauges, pressure transmitters, etc.

The HPU 22 may include a controller 94 in communication with various different components. For example, the controller 94 may be in communication with a variety of HPU components, including valving associated with the pumps 26, 54, an HPU pressure transmitter, a PRV pressure transmitter, pressure sensors, the reservoir float switch 90, the TPSDV 32, a two position directional valve, etc. The controller 94 may include any type of computing device, computational circuit, or any type of process or processing circuit capable of executing a series of instructions that are stored in memory. The controller 94 may include multiple processors and/or multicore CPUs and may include any type of processor, such as a microprocessor, digital signal processor, co-processors, a micro-controller, a microcomputer, a central processing unit, a field programmable gate array, a programmable logic device, a state machine, logic circuitry, analog circuitry, digital circuitry, etc., and any combination thereof. The instructions stored in memory may represent one or more algorithms for controlling the HPU 22/PRV 20, and the stored instructions are not limited to any particular faun (e.g., program files, system data, buffers, drivers, utilities, system programs, etc.) provided they can be executed by the controller. The memory may be a non-transitory computer readable storage medium configured to store instructions that when executed by one or more processors, cause the one or more processors to perform or cause the performance of certain functions. The memory may be a single memory device or a plurality of memory devices. A memory device may include a storage area network, network attached storage, as well a disk drive, a read-only memory, random access memory, volatile memory, non-volatile memory, static memory, dynamic memory, flash memory, cache memory, and/or any device that stores digital information. The HPU 22 may also include input (e.g., a keyboard, a touch screen, etc.) and output devices (a monitor, sensor readouts, data ports, etc.) that enable the operator to input instructions, receive data, etc.

Modes of Operation:

The HPU 22 is configurable in at least three different modes of operation (sometimes referred to as "failure modes") in the event of a loss of electrical power to the controller 94/HPU 22, and/or the loss of signal communication to the TPSDV 32: a PRV fail OPEN configuration, a PRV fail CLOSE configuration, and a PRV fail AS-IS configuration.

PRVs are often used for well drilling processes involving flow to ensure that excessive system pressures will not cause major failures in the well drilling system. For example, it is known to use a PRV with mud pump systems on well drilling rigs. The mud pump systems are typically high powered and deliver fluids at high flow rates and delivery pressures. Starting a mud pump against a closed valve or a plugged line will very likely result in major damage to the mud pump system unless the PRV for the mud system opens rapidly to relieve the excessive pressure.

"PRV Fail OPEN Configuration":

Referring to FIG. 4, in the PRV fail OPEN configuration, embodiments of the present disclosure HPU 22 are configured to switch the PRV 20 to an OPEN configuration in the event of a loss of electrical power to the controller 94/HPU 22, and/or the loss of signal communication to the TPSDV 32. In the OPEN configuration, the PRV 20 provides a pressure relief that prevents the formation of a potentially damaging pressure level within the mud pump system. For example, and as shown diagrammatically in FIG. 4, an embodiment of the present HPU 22 may include a TPSDV 32 with a spring return solenoid that is configured to default to a fail OPEN configuration upon the loss of electrical power to the HPU 22, and/or the loss of signal communication to the TPSDV 32. In this configuration, the TPSDV 32 defaults to a position wherein pressurized fluid within the HPU 22 (which may include pressurized fluid from the accumulator 30) is fed to the OPEN port 38 of the PRV 20 to cause the PRV 20 to be maintained in an OPEN configuration.

In the PRV fail OPEN configurations that include a throttle valve 76 and a check valve 78 disposed in parallel (e.g., see FIG. 4), the parallel throttle valve 76/check valve 78 are in communication with the line 64 extending to the OPEN port 38 of the PRV 20. Hence, the directional check valve 78 is configured to allow pressurized fluid to pass through to the PRV 20 and thereby bypass the throttle valve 76. As stated above, the parallel throttle valve 76 and check valve 78 are non-limiting examples of a valve configuration that may be used.

"PRV Fail CLOSE Configuration":

In the PRV fail CLOSE configuration, embodiments of the present disclosure HPU 22 are configured to switch the PRV 20 to a CLOSE configuration in the event of a loss of electrical power to the controller 94/HPU 22, and/or the loss of signal communication to the TPSDV 32. In the CLOSE configuration, the PRV 20 does not provide a pressure relief, but rather helps to maintain existing well pressure during drilling; e.g., maintain well pressure during drilling within a mud pump system. For example, and as shown diagrammatically in FIG. 3, an embodiment of the present HPU 22 may include a TPSDV 32 with a spring return solenoid 74 that is configured to default to a fail CLOSE configuration upon the loss of electrical power to the controller 94/HPU 22, and/or the loss of signal communication to the TPSDV 32. In this configuration, the TPSDV 32 defaults to a position wherein pressurized hydraulic fluid (which may include pressurized fluid from the accumulator 30) is fed to the CLOSE port 40 of the PRV 20 to cause the PRV 20 to move to, and be maintained in, a PRV fail CLOSE configuration.

In the PRV fail CLOSE configurations that include a throttle valve 76 and a check valve 78 disposed in parallel (e.g., see FIG. 3), the parallel throttle valve 76/check valve 78 are in communication with the line 66 extending to the OPEN port 38 of the PRV 20. Hence, the directional check valve 78 is configured to not allow fluid flow exiting the PRV 20 to pass through the check valve 78, thereby forcing the fluid exiting the PRV 20 to pass through the throttle valve 76. As stated above, the parallel throttle valve 76 and check valve 78 are non-limiting examples of a valve configuration that may be used.

Figure 6:
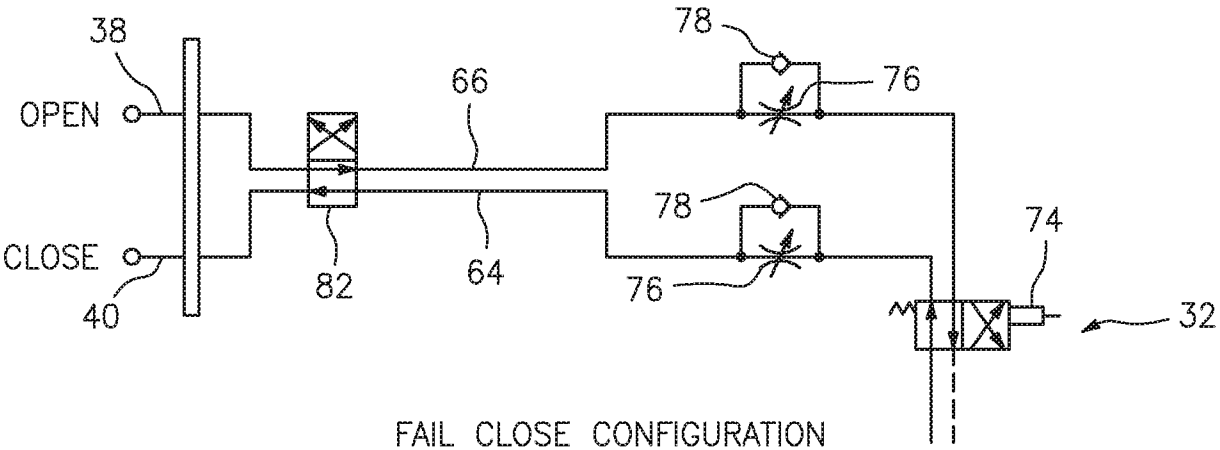
FIG. 6 is a schematic view of a portion of an embodiment of the hydraulic power unit embodiment shown in FIG. 1, showing a fail CLOSE configuration.
Figure 7:
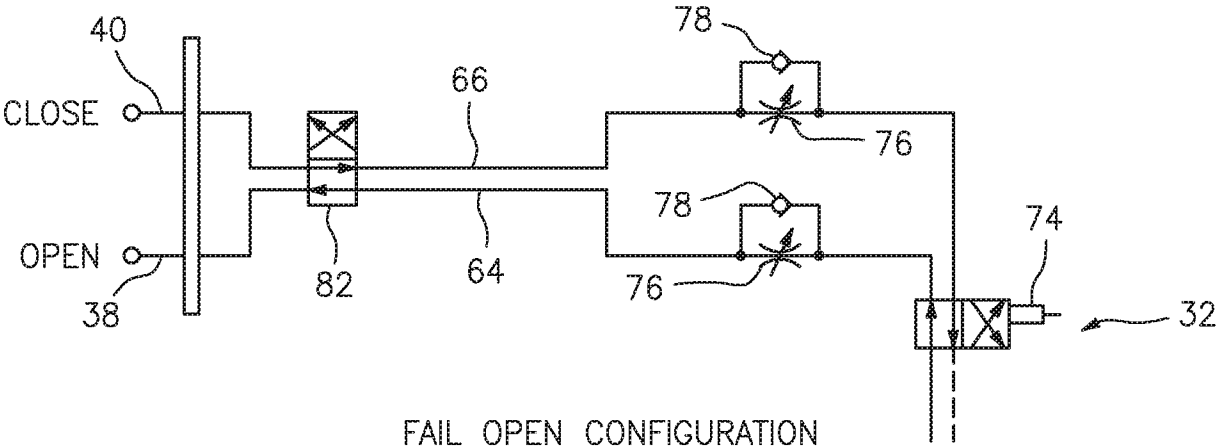
FIG. 7 is a schematic view of a portion of an embodiment of the hydraulic power unit embodiment shown in FIG. 1, showing a fail OPEN configuration.

As stated above, in some embodiments a valve configuration (e.g., a throttle valve 76 and a check valve 78 and/or a fluid control valve 80, 80A) may be disposed within both of the lines 64, 66 connecting the TPSDV 32 to the PRV 20. Using the throttle valve 76 and a check valve embodiment to illustrate, the parallel throttle valve 76 and check valve 78 are configured in each line so that fluid flow to the PRV 20 through one of the lines 64, 66 passes principally through the directional check valve 78 (i.e., path of least resistance) with minimal impedance, and fluid exiting the PRV 20 through the other line 66, 64 cannot pass through the check valve 78 but must instead pass through the throttle valve 76. FIG. 6 shows an HPU 22 in a PRV fail CLOSE configuration and FIG. 7 shows an HPU 22 in a PRV fail OPEN configuration. Embodiments that include a valve configuration (e.g., throttle valve 76 and a check valve 78 disposed in parallel) within both of the lines 64, 66 connecting the TPSDV 32 to the PRV 20 facilitate converting the HPU 22 from a fail OPEN configuration to a fail CLOSE configuration (and vice versa); e.g., there is no need to remove the throttle valve 76/check valve 78 from one line to the other to change from one configuration to the other. With the HPU 22 configurations shown in FIGS. 6 and 7, the change from a fail OPEN configuration (e.g., FIG. 6) to a fail CLOSE configuration (e.g., FIG. 7) may be accomplished by changing the positions of the lines 64, 66 relative to the ports 38, 40 of the PRV 20; e.g., line 66 connected to PRV OPEN port 38 (as shown in FIG. 6), can be switched to PRV CLOSE port 40 (as shown in FIG. 7) and vice versa for line 64. Hence, the HPU 22 can accommodate multiple failure operational modes in a single HPU 22 design. As stated above, in those embodiments wherein a throttle valve 76 (or other flow restriction device) is used, an adjustable orifice throttle valve (e.g., solenoid operated that may be controlled by the controller 94) may be used to minimize or remove the fluid flow restriction that would otherwise be caused by the valve in situations where it is desired to open the PRV as quickly as possible.

Alternatively, as explained below and shown in FIGS. 8 and 8A, the HPU 22 may include an automated two position directional valve 182 (4way/2pos) in communication with the lines 64, 66. The two position directional valve 182 may actuated via instructions from the controller 94 to change the fluid communication paths between the lines 64, 66 and the OPEN and CLOSE ports 38, 40 of the PRV; e.g., the controller may include instructions (e.g., operated via user input) that when implemented cause the two position directional valve 182 to switch positions, thereby changing the HPU from a fail CLOSE configuration (e.g., see FIG. 8) to a fail OPEN configuration (e.g., see FIG. 8A).

In those HPU 22 embodiments that include a valve 80, 80A (e.g., a ball valve) positioned parallel to each line connecting the TPSDV 32 to the PRV 20 (e.g., see FIGS. 6 and 7), the HPU 22 is configured so that the valve 80 in communication with the line 64 extending to the CLOSE port 40 of the PRV 20 is closed in the PRV fail OPEN configuration, and the valve 80A in communication with the line 66 extending to the OPEN port 38 of the PRV 20 is open in the PRV fail OPEN configuration (see FIGS. 6 and 7), and conversely the valve 80A in communication with the line 66 extending to the CLOSE port 40 of the PRV 20 is open in the PRV fail CLOSED configuration, and the valve 80 in communication with the line 64 extending to the OPEN port 38 of the PRV 20 is closed in the PRV fail CLOSED configuration. As stated above, each valve 80, 80A may be manually operated between a closed configuration and an open configuration. Alternatively, each valve 80, 80A may be configured for automated operation; e.g., solenoid operated valves 80, 80A. The automated valves 80, 80A may actuated via instructions from the controller 94 to change from an open configuration to a closed configuration, or vice versa. In these embodiments, the valves 80, 80A may be utilized with the check valves 78 as shown in FIGS. 8, 8A, 9, and 9A, or may be utilized without the check valves 78.

In some embodiments where mud pump protection (e.g., protection from excessive pressure) is desired during a PRV fail CLOSE configuration, the controller can be adapted to provide instructions to the mud pumps modify the performance of the mud pumps (e.g., instructions that cause the mud pumps to decrease their strokes per minute—SPM) and thereby decrease the potential for over pressurization of the mud pumps that may otherwise potentially lead to damage.

"PRV Fail AS-IS Configuration":

In the PRV fail AS-IS configuration, embodiments of the present disclosure HPU 22 are configured to maintain the current state of the PRV 20 in the event of a loss of electrical power to the controller 94/HPU 22, and/or the loss of signal communication to the TPSDV 32. Maintaining the PRV 20 in its current state in the event of a loss of electrical power to the HPU 22, and/or the loss of signal communication to the TPSDV 32, will prevent any unintentional movement of the PRV 20 in a safety critical operation.

Figure 5:
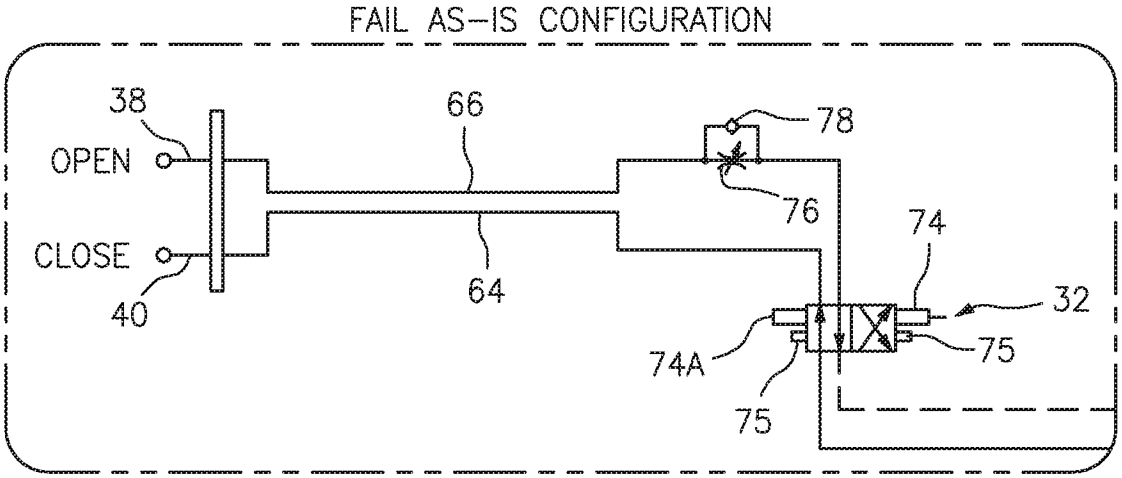
FIG. 5 is a schematic view of a portion of an embodiment of the hydraulic power unit embodiment shown in FIG. 1, showing a fail AS-IS configuration.

For example, and as shown diagrammatically in FIG. 5, an embodiment of the present HPU 22 may include a TPSDV 32 that is detented. The detented TPSDV 32 coupled with the PRV 20 results in the TPSDV 32 having a fail default in its current position. As a result, the PRV 20 also remains in its current state OPEN or CLOSE configuration upon loss of power/loss of solenoid signal.

Initial testing suggests that embodiments of the above described HPU 22 are able to provide an increased acceleration of PRV 20 opening/closing times with less number of components/tubing (e.g., 200 ms cycle time). Since the potential for over pressurization and damage attributable to over pressurization increase with PRV 20 operation lag, the decreased PRV 20 response is believed to provide a benefit to the user.

In those embodiments that include a return filter 96, the return filter 96 is useful in reducing the contaminant level within the hydraulic oil, which is understood to increase the longevity of the pump 26, 54 and thus keeping the HPU 22 operational to function the PRVs.

In those embodiments that include a reservoir float level switch 90 in addition to a sight glass 92, it is believed that the redundancy will facilitate reservoir 28 fluid level monitoring to prevent pump 26, 54 from running dry and get damaged.

In those embodiments that include a secondary pump 54, it is believed that the redundancy of the pumps will decrease or avoid down time that may be caused by a primary pump 26 malfunction.

The ability of the present disclosure to be readily configured—manually or in an automated manner—in a PRV fail OPEN configuration, a PRV fail CLOSE configuration, or a PRV fail AS-IS configuration provides considerable utility. For example, the same HPU can be used for different purposes, thereby avoiding the need for multiple units and the space requirements and costs associated therewith.

What is claimed is:

1. A hydraulic power unit (HPU) configured for use with a pressure relief valve (PRV) having an open port and a close port, the HPU comprising:

a pneumatic powered primary pump;

a hydraulic fluid reservoir in fluid communication with the primary pump;

an accumulator;

a first two position solenoid directional valve (TPSDV) in communication with the primary pump, the reservoir, the accumulator;

a second TPSDV disposable in a first configuration or a second configuration;

at least one first fluid line; and at least one second fluid line;

wherein in the second TPSDV first configuration the at least one first fluid line provides fluid communication between the first TPSDV and the close port of the PRV, and the at least one second fluid line provides fluid communication between the first TPSDV and the open port of the PRV, and in the second TPSDV second configuration the at least one first fluid line provides fluid communication between the first TPSDV and the open port of the PRV, and the at least one second fluid line provides fluid communication between the first TPSDV and the close port of the PRV; and wherein the HPU is configurable in a PRV fail open configuration and a PRV fail close configuration.

2. The HPU of claim 1, wherein in the PRV fail close configuration, the HPU is configured to provide hydraulic fluid at an elevated pressure to the close port of the PRV, which elevated pressure is adequate to maintain the PRV in a closed configuration.

3. The HPU of claim 2, further comprising:

at least one valve in fluid communication with the at least one second fluid line, the at least one valve including at least one fluid flow restriction valve and at least one fluid flow valve disposed in parallel with one another, and the fluid flow valve has an open configuration and a closed configuration;

wherein the at least one valve is configured so that fluid flow from the open port of the PRV is restricted.

4. The HPU of claim 1, wherein in the PRV fail open configuration, the HPU is configured to provide hydraulic fluid at an elevated pressure to the open port of the PRV, which elevated pressure is adequate to maintain the PRV in an open configuration.

5. The HPU of claim 4, further comprising:

at least one valve in fluid communication with the at least one second fluid line;

wherein the at least one valve is configured to permit fluid flow at the elevated pressure to pass through the at least one valve to the open port of the PRV.

6. The HPU of claim 1, wherein the hydraulic fluid reservoir includes at least one of a float switch or a sight glass.

7. The HPU of claim 1, further comprising a pneumatic secondary pump in fluid communication with the TPSDV.

8. A hydraulic power unit (HPU) configured for use with a pressure relief valve (PRV) having an open port and a close port, the HPU comprising:

a pneumatic primary pump;

a hydraulic fluid reservoir in fluid communication with the primary pump;

an accumulator; and a two position solenoid directional valve (TPSDV) in communication with the primary pump, the reservoir, the accumulator, and the TPSDV is configured for fluid communication with the PRV;

wherein the HPU is selectively configurable in a PRV fail open configuration, a PRV fail close configuration, and a PRV fail as-is configuration.

9. A hydraulic power unit system, comprising:

a pressure relief valve (PRV) having an open port and a close port; and a hydraulic power unit (HPU) that includes:

a pneumatic powered primary pump;

a hydraulic fluid reservoir in fluid communication with the primary pump;

an accumulator;

a first two position solenoid directional valve (TPSDV) in communication with the primary pump, the reservoir, the accumulator;

a second TPSDV disposable in a first configuration or a second configuration;

at least one first fluid line; and at least one second fluid line;

wherein in the second TPSDV first configuration the at least one first fluid line provides fluid communication between the first TPSDV and the close port of the PRV, and the at least one second fluid line provides fluid communication between the first TPSDV and the open port of the PRV, and in the second TPSDV second configuration the at least one first fluid line provides fluid communication between the first TPSDV and the open port of the PRV, and the at least one second fluid line provides fluid communication between the first TPSDV and the close port of the PRV; and wherein the HPU is configurable in a PRV fail open configuration and a PRV fail close configuration.

10. The system of claim 9, wherein in the PRV fail close configuration, the HPU is configured to provide hydraulic fluid at an elevated pressure to the close port of the PRV, which elevated pressure is adequate to maintain the PRV in a close configuration.

11. The system of claim 10, further comprising:

at least one valve in fluid communication with the at least one second fluid line, the at least one valve including at least one fluid flow restriction valve and at least one fluid flow valve disposed in parallel with one another, and the fluid flow valve has an open configuration and a closed configuration;

wherein the at least one valve is configured so that fluid flow from the open port of the PRV is restricted.

12. The system of claim 9, wherein in the PRV fail open configuration, the HPU is configured to provide hydraulic fluid at an elevated pressure to the open port of the PRV, which elevated pressure is adequate to maintain the PRV in an open configuration.

13. The system of claim 9, wherein in the PRV fail close configuration, the HPU is configured to provide hydraulic fluid at a first elevated pressure to the close port of the PRV, which first elevated pressure is adequate to maintain the PRV in a closed configuration, and in the PRV fail open configuration, the HPU is configured to provide hydraulic fluid at a second elevated pressure to the open port of the PRV, which second elevated pressure is adequate to maintain the PRV in an open configuration.

14. The system of claim 13, further comprising:

at least one first valve in fluid communication with the at least one first fluid line; and at least one second valve in fluid communication with the at least one second fluid line;

wherein the at least one second valve is configured to restrict fluid flow from the PRV open port when the HPU is in the PRV fail close configuration.

15. The system of claim 13, further comprising:

at least one first valve in fluid communication with the at least one first fluid line; and at least one second valve in fluid communication with the at least one second fluid line;

wherein the at least one second valve is configured to restrict fluid flow from the PRV close port when the HPU is in the PRV fail open configuration.

16. The system of claim 9, wherein the HPU further comprises:

at least one first fluid line providing fluid communication between the first TPSDV and the close port of the PRV;

at least one second fluid line providing fluid communication between the first TPSDV and the open port of the PRV;

at least one first valve in fluid communication with the at least one first fluid line;

at least one second valve in fluid communication with the at least one second fluid line; and a controller that includes at least one processor in communication with the at least one first valve and the at least one second valve, and a memory storing instructions, which instructions when executed cause the processor to selectively operate the at least one first valve in a first open configuration or a first close configuration, and to selectively operate the at least one second valve in a second open configuration or a second close configuration.

17. The system of claim 9, wherein the hydraulic fluid reservoir includes at least one of a float switch or a sight glass.

18. The system of claim 9, further comprising a pneumatic secondary pump in fluid communication with the first TPSDV.

19. A hydraulic power unit system, comprising:

a pressure relief valve (PRV) having an open port and a close port; and a hydraulic power unit (HPU) that includes:

a pneumatic primary pump;

a hydraulic fluid reservoir in fluid communication with the primary pump;

an accumulator; and a first two position solenoid directional valve (TPSDV) in communication with the primary pump, the reservoir, the accumulator, and the first TPSDV is configured for fluid communication with the PRV;

wherein the HPU is selectively configurable in a PRV fail open configuration, a PRV fail close configuration, and in a PRV fail as-is configuration.

* * * * *